United States Patent [19]

Sunnen et al.

[11] Patent Number: 4,621,455

[45] Date of Patent: Nov. 11, 1986

[54] COMBINATION HORIZONTAL/VERTICAL HONING MACHINE

[75] Inventors: Robert M. Sunnen, Frontenac; Wayne W. Althen, St. Louis County; Rickey S. Riehl, Brentwood, all of Mo.

[73] Assignee: Sunnen Products Company, St. Louis, Mo.

[21] Appl. No.: 775,229

[22] Filed: Sep. 12, 1985

[51] Int. Cl.[4] ..... B24B 33/08

[52] U.S. Cl. ..... 51/34 R; 51/34 H

[58] Field of Search ..... 51/34 R, 34 H, 33 R, 51/32, 31, 165, 93, 34 C, 34 K, 34 J, 348, 47, 71, 72 R, 94 R, 96, 99

[56] References Cited

U.S. PATENT DOCUMENTS

| | | | |
|---|---|---|---|
| 4,101,405 | 7/1978 | Inoue . | |
| 4,155,201 | 5/1979 | Amundsen | 51/34 C |
| 4,180,945 | 1/1980 | Zimmerman | 51/34 C |
| 4,423,567 | 1/1984 | Raven, III | 51/34 R |

*Primary Examiner*—Frederick R. Schmidt
*Assistant Examiner*—Maurina Rachuba
*Attorney, Agent, or Firm*—Haverstock, Garrett & Roberts

[57] ABSTRACT

A honing machine having capability to hone surfaces at different angular orientations using rocking motion to produce the stroking when honing in one orientation and linear motion to produce the stroking when honing in a different angular orientation, including a support structure mounted for linear movement on a rail and an arm assembly extending from the support structure, the arm assembly being pivotal on the support structure to produce the rocking motion in the one orientation of the support structure, the arm assembly moving with the support structure in the other angular orientation thereof to produce the linear movement thereof. The machine also includes latch device to maintain the support structure in the one orientation thereof. The latch device includes a mechanism to control the limits of stroking in the one orientation, and it includes apparatus to counterbalance the arm assembly. The latch device operates to deactivate the counterbalance apparatus when the support structure is moved to its other orientation.

30 Claims, 14 Drawing Figures

COMBINATION HORIZONTAL/VERTICAL HONING MACHINE

BACKGROUND OF THE INVENTION

The present invention relates generally to honing machines and, more particularly, to a honing machine including a mandrel support structure movable to a first position for honing surfaces in one orientation using a vertical motion to stroke the honing mandrel assembly operatively attached thereto and to a second position for honing surfaces at a different orientation using linear motion producing means to stroke the honing mandrel assembly.

DESCRIPTION OF RELATED ART

There is an increasing need in the honing field for a relatively inexpensive manually-operated honing machine that is adapted to stroke a rotating honing mandrel in both horizontal and vertical directions. Such optional choice of stroking direction enables the operator to fixture short parts vertically and long parts horizontally which is generally the most convenient for each. In automotive engine repair shops for instance it is desirable to hone the piston cylinders vertically, but hone the long main bearing tunnel horizontally. In the case of automotive work, it is also important that the machine be equipped with fixturing to enable all cylinders of a V-type engine to be honed without need for refixturing the blocks. The capability of being able to accurately hone all such work surfaces using the same machine saves the cost of a second machine, reduces floor space needed to perform the work and represents a significant improvement in the honing art. By being able to accomplish this, even small service shops will be able economically to perform more honing work on engines thereby lessening the need for small shops to send work out and to rely on outsiders to complete some of the service work for customers.

In addition, it is important that the stroking action be properly designed into the machine in order to accommodate the type of work to be performed. Many workpiece surfaces and particularly the spaced aligned surfaces for the main bearings of an internal combustion engine block require honing devices that are able to hone spaced surfaces over relatively long distances. To hone such surfaces it is important that the means that support and move the honing mandrel assembly be moved by linear movement means rather than by means that rock or move arcuately. A rocking or arcuately moving stroking means is less costly to build and is perfectly suitable for moving a mandrel assembly during the honing of relatively short bores such as cylinder bores but are not suitable to produce the stroking needed for honing over greater distances including up to several feet or longer. The present improved machine construction satisfies these and other needs by providing means which enable the use of economic arcuate stroking of a honing mandrel when honing surfaces in one orientation, and which has other means to impart linear stroking motion to a honing mandrel in another orientation when used to hone longer bore surfaces such as the aligned main bearing surfaces on engine blocks or to hone long tubular surfaces.

It is also contemplated to move the arm assembly and the honing mandrel operatively attached thereto in a vertical orientation on vertically oriented track means although this is usually not preferred for expense reasons.

It is also important to the present invention when making the transition of the machine from honing the piston cylinder surfaces to honing the main bearing surfaces that the changeover be able to be accomplished simply, quickly, safely and accurately, and that the changeover be able to be accomplished even by persons having relatively little skill and training. The present honing construction has all of these and other features and advantages.

Some known machines are able to operate within limited ranges of bore lengths, but are incapable of being used to hone longer bore surfaces or aligned bore surfaces spaced over relatively long distances, such as to hone main bearing bore surfaces of engine blocks and the like. Typical of these limited stroke length honing machines is the construction disclosed in advertising literature of Delapena Honing Equipment Limited of England, which machine includes a rotatable mandrel supporting arm member capable of pivotally stroking a honing mandrel at several different orientations. The limited pivotal stroking motion of the Delapena construction greatly limits the ranges of bore surface lengths the machine is capable of honing, which makes it unsuitable for honing surfaces such as the spaced main bearing surfaces on an engine block and relatively long bore surfaces such as hydraulic cylinders.

The subject honing machine construction therefore overcomes the shortcomings, operating disadvantages and limitations of known honing machines, and provides novel and useful means for honing angularly related surfaces on workpieces, as will hereinafter be more further explained. The present honing machine is also relatively inexpensive to construct thereby making it available to more businesses including relatively small shops and auto repair centers.

SUMMARY OF THE INVENTION

The present invention relates to an improved honing machine that is capable of rotatably driving different types of honing mandrel assemblies such as those that are used to hone different kinds of angularly related surfaces on a workpiece, and the improved honing machine is able to be changed by an operator from honing a bore in one plane to a bore with a different orientation on the same or on a different workpiece with only minimal time and effort required to make the changeover. The different types of honing mandrel assemblies employed can be operatively attached to and driven from one end of an arm assembly which in one position is positioned extending above a workpiece having a surface to be honed that is supported in a housing structure. In this position, the arm assembly is pivotally or otherwise mounted to the upper end of an elongated support structure for enabling the production of vertical stroking motions. The support structure to which the arm assembly is attached is mounted for movement on rail means located along the rear of the machine housing, and the means mounting the support structure enable the support structure with the arm assembly attached to be moved while supported by the rail means between different positions along the rail means to permit alignment with spaced cylindrical surfaces to be honed. The support structure may be pivotally moved between a first upstanding operative position wherein the structure extends upwardly in substantially a vertical orientation for vertical honing and a second overturned operative position wherein the structure extends in a substantially horizontal orientation for horizontal honing. The arm assembly is able to be pivotally or otherwise vertically moved by the machine operator relative to the support structure in its vertical first operative position as aforesaid to enable the mandrel assembly to be stroked with a vertical stroking motion. However, the arm assembly is preferably locked in fixed angular orientation on the support structure in its second overturned horizontal operative position so that the support structure including the arm assembly and the honing mandrel assembly operatively attached thereto are able to be stroked horizontally with a linear stroking motion, being guided by the rail means, to produce the linear stroking motion.

OBJECTS OF THE INVENTION

It is a principal object of the present invention to provide a honing machine that can be used to hone surfaces of a workpiece that are angularly related to each other.

Another object is to provide an arm assembly mounted on a support structure movable between an upstanding operative position and an operative position at right angles thereto, the arm assembly being movable relative to the support structure in the upstanding position and being movable linearly with the support structure in the position at right angles thereto.

Another object is to provide a honing machine including a pivotal mandrel support structure that includes means to rotatably drive a honing mandrel assembly in different angular orientations and wherein the mandrel can be stroked using a rocking motion in one orientation and can be stroked using a linear stroking motion in another orientation.

Another object is to provide means to lock a honing arm member to a support structure therefor in at least one position thereof such that the arm member is prevented from movement relative to the support structure as the support structure, the arm member and a honing mandrel operatively attached thereto are moved with a linear stroking motion being guided by rail means.

Another object is to provide horizontal rail support means to support a honing mandrel and associated means attached thereto during vertical stroking in any position along the length of the horizontal rail support means.

Another object is to provide horizontal rail support means to support a honing mandrel and associated means attached thereto during horizontal stroking.

Another object is to simplify the changeover procedure required to convert a honing machine from honing at one operative orientation to honing at another orientation.

Another object is to reduce the cost of honing the cylindrical surfaces of engine blocks and like devices.

Another object is to make it possible for persons having relatively little skill and training to accurately perform all of the honing necessary on workpieces such as engine blocks and the like.

Another object is to make it possible for relatively small businesses such as engine repair shops and the like to become more versatile by being able to perform more complete high quality honing of cylindrical surfaces on engine blocks and like structures.

Another object is to teach the construction and operation of a relatively inexpensive yet highly versatile honing machine that is able to perform more different kinds of honing operations on a workpiece than known machines.

These and other objects and advantages of the present invention will become apparent to those skilled in the art after considering the following detailed specification in conjunction with the accompanying drawings, wherein:

DESCRIPTION OF THE PREFERRED EMBODIMENT

Figure 1:
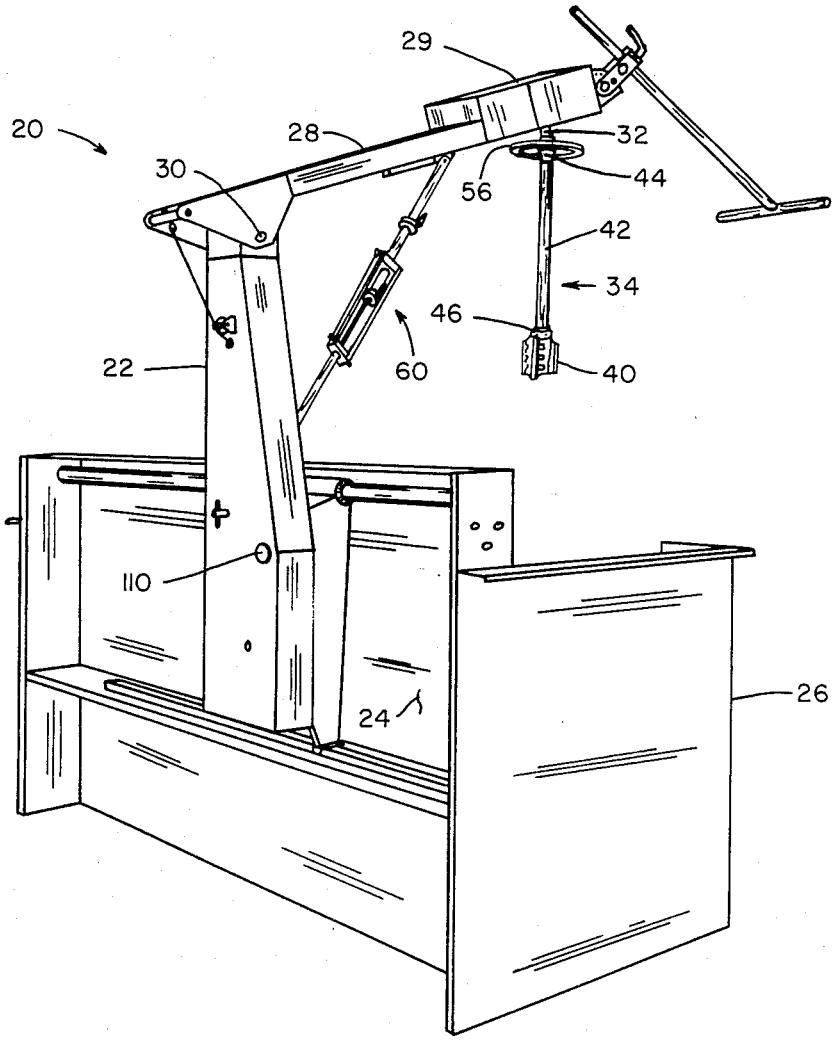
FIG. 1 is a rear perspective view of a preferred embodiment of a honing machine constructed according to the present invention, the machine being shown in condition to hone surfaces of a workpiece in a vertical orientation.
Figure 10:
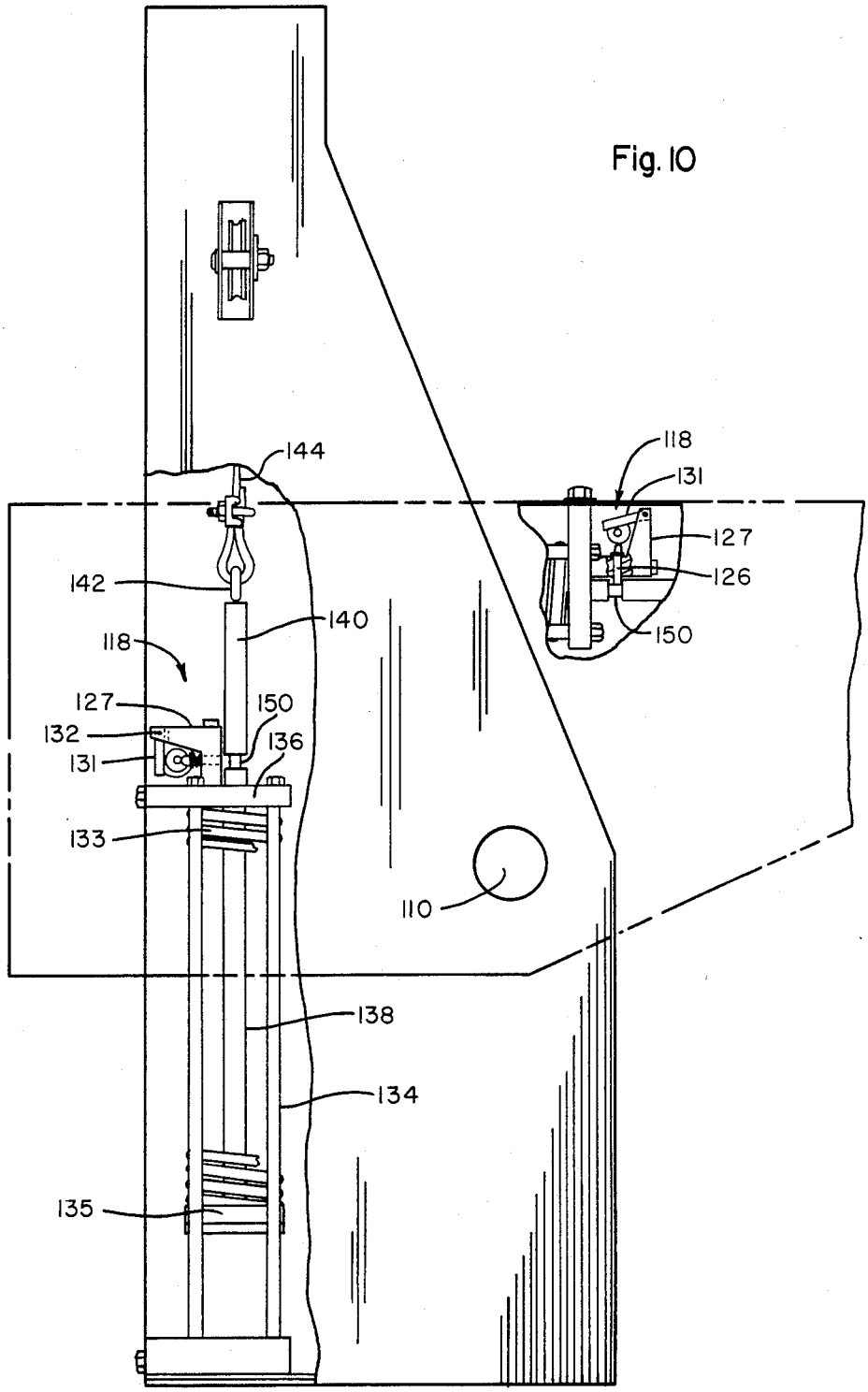
FIG. 10 is a rear view, partly cut away, to show inner details of the main support structure, said structure being shown in vertical orientation in solid outline and in horizontal orientation in dotted outline.
Figure 13:
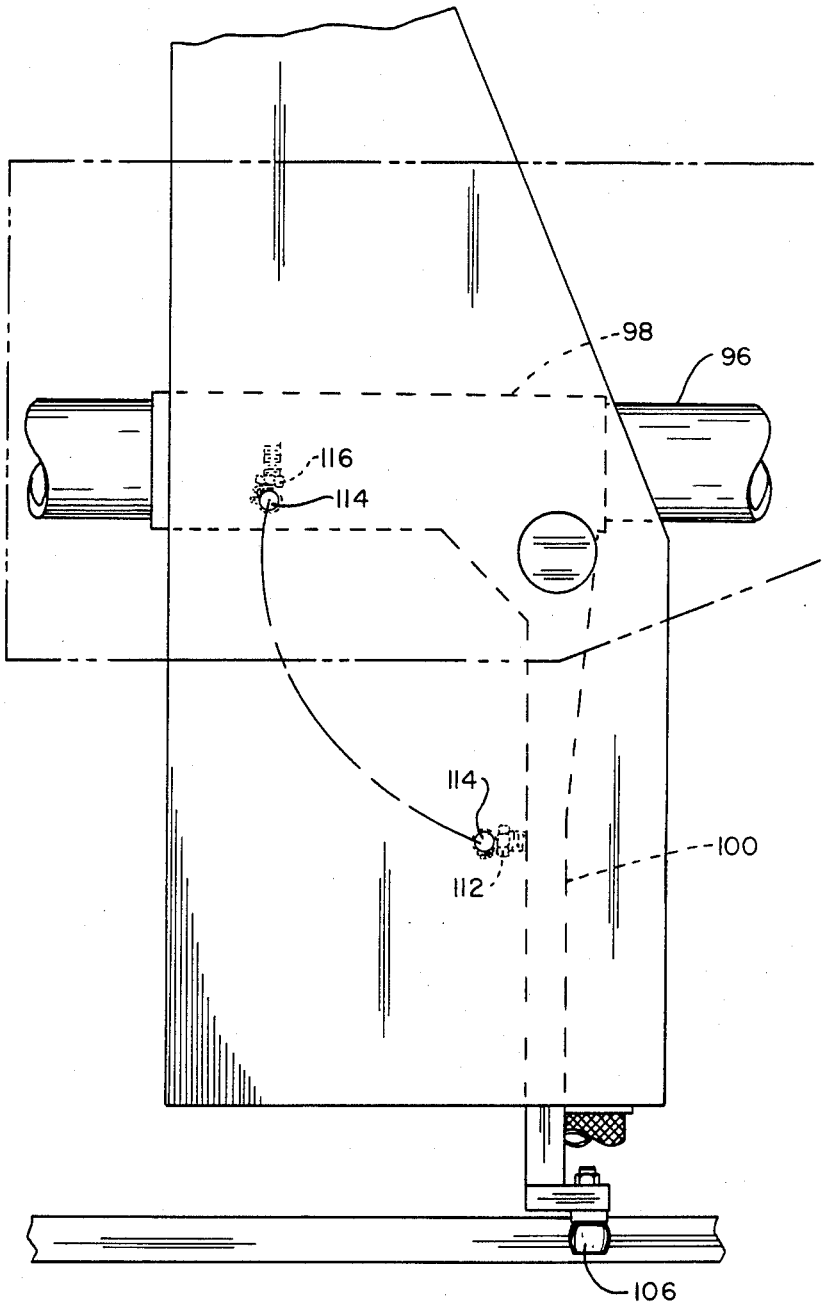
FIG. 13 is a fragmentary rear view of the main support structure and of the rail and guide means therefor.

Referring to the drawings more particularly by reference numbers, wherein like numerals refer to like parts, number 20 in FIG. 1 identifies a preferred embodiment of a honing machine constructed to enable the operator thereof to hone cylindrical surfaces oriented at different angular orientations such as at vertical and horizontal orientations. Typical of bores that can be honed using the subject machine are the cylinder bores and the main bearing bore surfaces of an engine block. To this end, the present machine 20 has a main support structure 22 that is mounted as will be explained on or adjacent to a rear wall structure 24 of machine housing 26. The main support structure 22 is mounted for pivotal movement between a vertical or upstanding position as shown in FIGS. 1, 2, 3 and 10 and a horizontal or overturned position as shown in FIGS. 10 and 13.

Figures 4, 5:
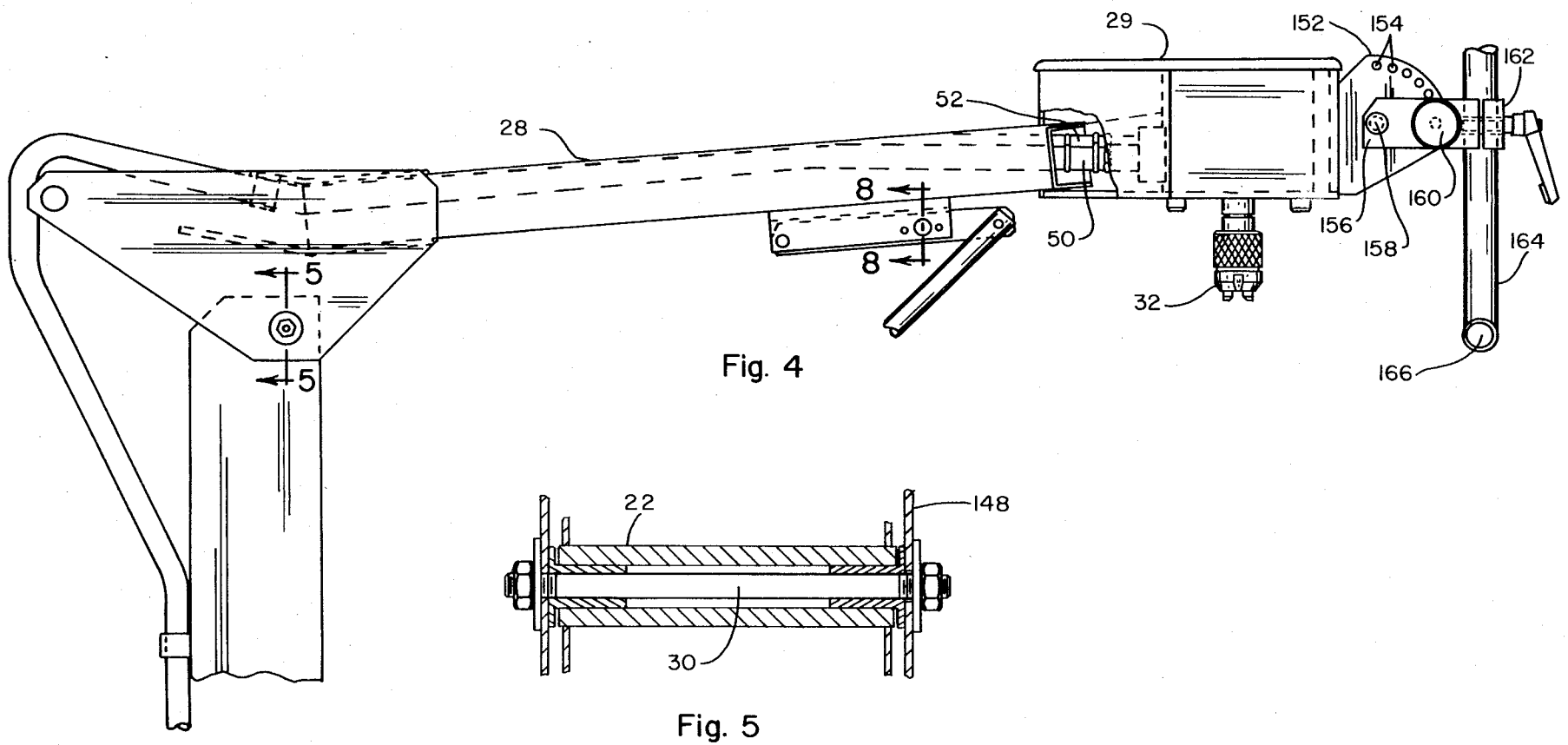
FIG. 4 is a side elevational view of the arm assembly.
FIG. 5 is a fragmentary cross-sectional view taken along line 5—5 of FIG. 4.

An arm assembly 28 is pivotally attached to the main support structure 22 adjacent to a free end thereof at pivot 30 shown in detail in FIG. 5. The arm assembly 28 extends forwardly at an angle from the main support structure 22, and the free end 29 of the arm assembly 28 has coupling means such as bayonet coupling 32 attached thereto for attaching and detaching a honing mandrel and associated assembly 34 of some type thereto. In the upstanding position of the main support structure 22 the mandrel assembly 34, including the coupling means 32 therefor for honing vertically oriented cylinder bores such as bores of an engine block, is suspended in relatively free-swinging position from adjacent the forward free end 29 of the arm assembly 28.

Figure 7:
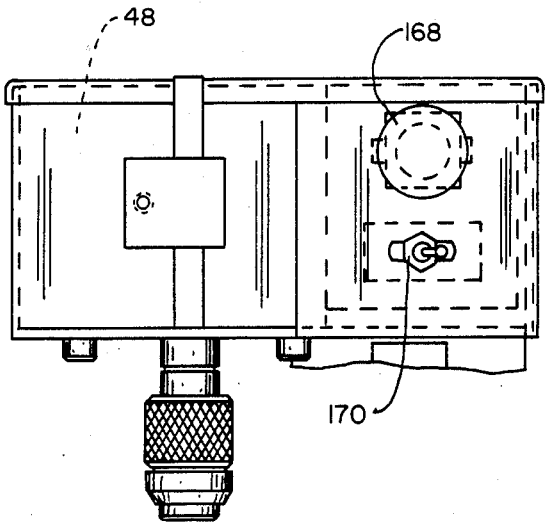
FIG. 7 is a right end view of the arm assembly of FIG. 6.
Figure 6:
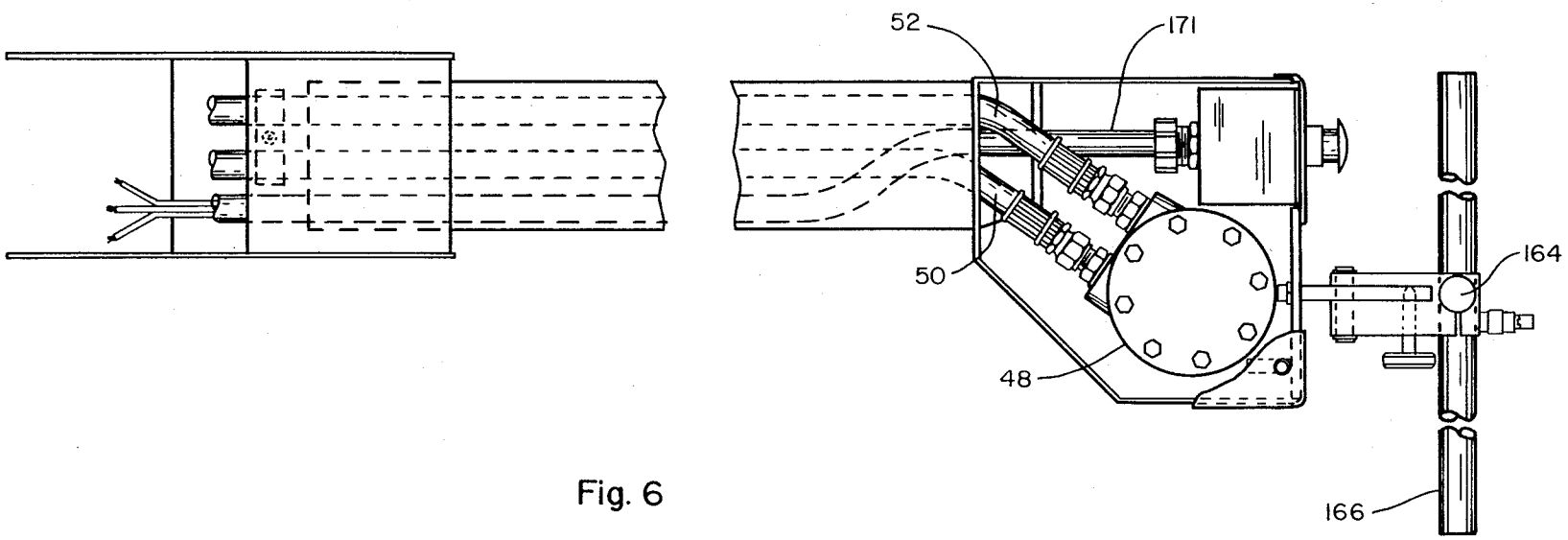
FIG. 6 is a top plan view of the arm assembly and associated components.

The mandrel assembly 34 may be of known construction including having a honing mandrel or head portion 40 which typically may be of the types shown in Sunnen U.S. Pat. Nos. 3,216,155 and 3,378,962. The mandrel 40 is coupled to the bayonet coupling means 32 on the arm assembly 28 by a drive tube 42 which has universal joint connections 44 and 46 adjacent the opposite ends thereof. The drive tube 42 is operatively connected through the coupling means 32 to an hydraulic motor 48 which is located near the free end 29 of the arm assembly 28 (FIGS. 6 and 7). The hydraulic motor 48 is connected by hoses or tubes 50 and 52 which extend along the arm assembly 28 and down the support structure 22 (FIGS. 4 and 6). When the power is on to the mandrel assembly 34, hydraulic pressure is applied to the hydraulic motor 48 through the hoses 50 and 52. It should be understood, however, that the means to drive the mandrel assembly 34 are not critical and other forms of drive means including an electric motor coupled to the mandrel assembly including through pulleys and belts could also be used.

The mandrel 40 also requires feed-up means to expand and contract the work engaging elements thereon such as the honing stones and guides. The feed-up means include a feed rod (not shown) that extends through the drive tube 42. The feed rod is operatively connected to a rack and pinion arrangement or to a cam feed-up device (not shown) located in the mandrel 40 such as is shown in the referenced Sunnen patents. The force for driving the feed-up means may be manual and is transmitted through the feed rod which likewise has universal joint connections adjacent each opposite end thereof at locations corresponding to the locations of the universal connections 44 and 46 for the drive tube 42. This makes it possible for the mandrel assembly 34 including the drive tube 42 and the feed rod to be able to swing freely on the arm assembly 28 for locating the mandrel 40 in position in a vertically oriented cylinder bore to be honed. The power for rotating the feed-up rod to radially expand or retract the honing diameter for the subject device can be provided by a manual feed-up control such as by a feed-up wheel 56 (FIG. 1) conveniently located below and adjacent to the free end 29 of the arm assembly 28. The feed-up wheel 56 may be of conventional construction including having the wheel 56 such that friction can be applied thereto by having the operator rub his hand against it to apply feed-up pressure through the feed rod to the work engaging portions of the honing head 40 to maintain them frictionally engaged with the work surface being honed. Alternatively, automatic feed-up control means could be provided but this is usually not necessary and may excessively increase the cost of the machine. The construction and operation of the mandrel assembly 34 including the mandrel head 40, the drive tube 42, the feed rod and the controls therefor may all be of known construction.

The manner in which the arm assembly 28 is moved or stroked with the mandrel assembly 34 attached thereto in the different operating positions is important in the present construction. The main support structure 22 and the arm assembly 28 attached thereto are also capable of being moved horizontally when the support structure is in its vertical orientation so that it can be used to hone at different operating positions such as to hone in different cylinder bores. It is also important that the arm assembly 28 be counterbalanced on the main support structure 22 when honing in a vertical orientation so that relatively little force will be required to pivotally move or rock the arm assembly 28 with the mandrel assembly 34 attached thereto. This action produces an arcuate stroking movement of the forward end 29 of the arm 28 and in turn produces linear movement of the mandrel 40 in the work surface. An alternate embodiment shown in FIG. 14 would provide vertical rail support means on the support structure 22 permitting linear movement of the arm assembly 28 in a vertical plane.

Figure 2:
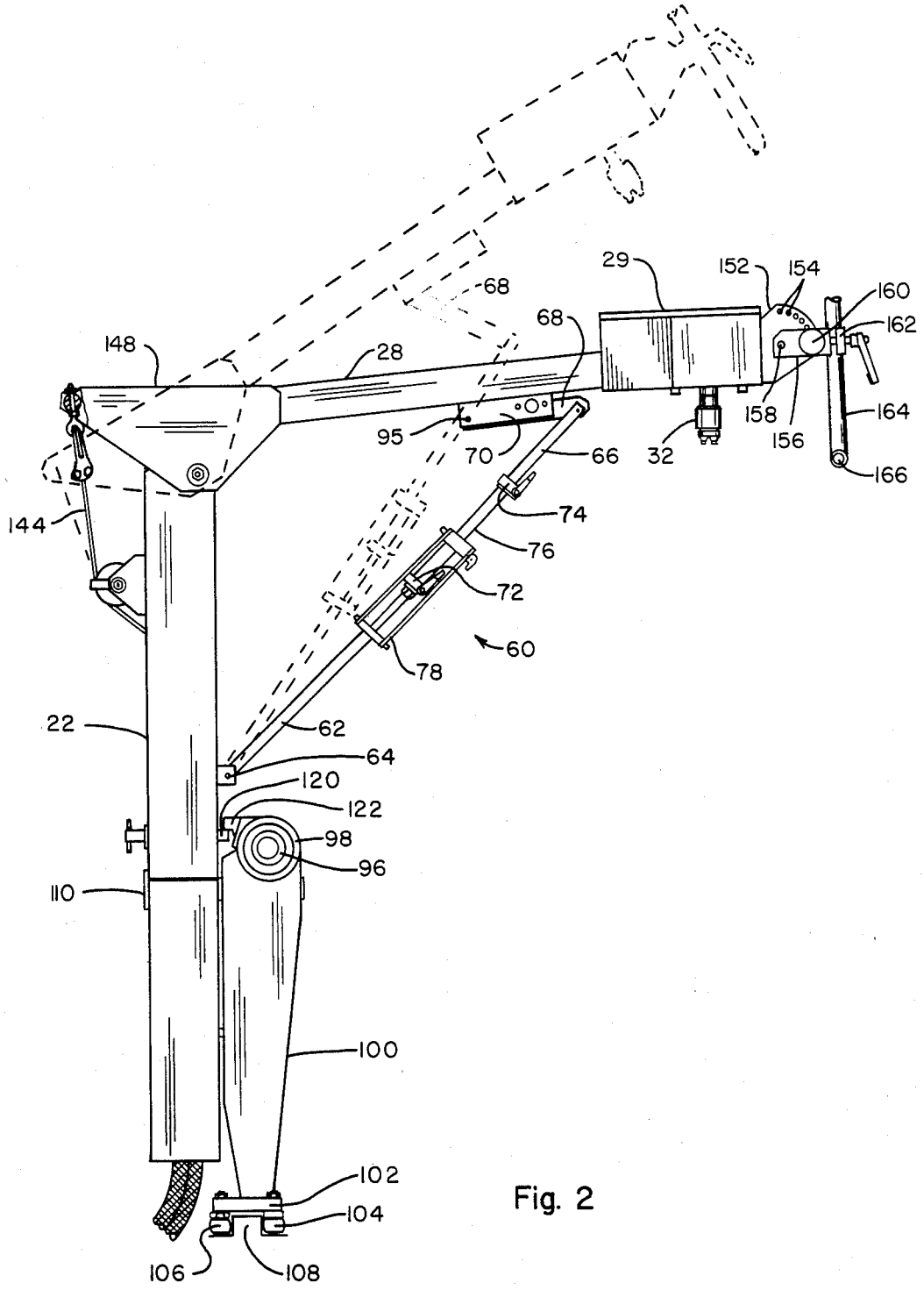
FIG. 2 is a fragmentary side elevational view of the main support structure of the honing machine of FIG. 1 showing in solid outline the operating position of a pivotal arm assembly and showing the same arm assembly in phantom outline moved to a raised inoperative position in which a honing mandrel assembly can be attached to or detached from the arm assembly or moved sidewardly to hone at a different position.
Figure 9:
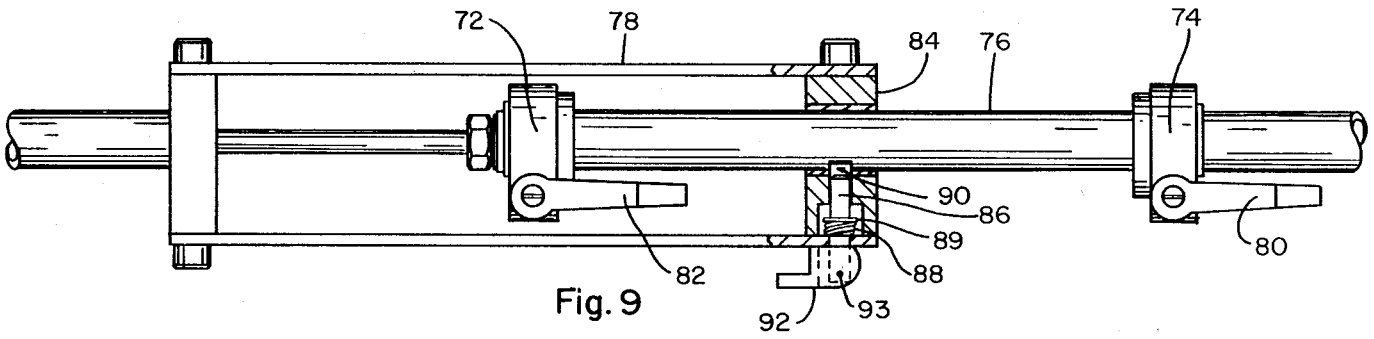
FIG. 9 is an enlarged fragmentary side elevational view of a slide assembly used for stroke length control, the slide mechanism being connected between the arm assembly and the main support structure.

The limits on the stroking movement produced by rocking the arm assembly 28 is controlled by adjustable slide assembly 60 which is shown in FIGS. 1, 2 and 9. One end 62 of the slide assembly 60 is pivotally connected to the main support structure 22 at pivot point 64 and the opposite end 66 of the slide assembly 60 is connected to bracket arm 68 which is part of latch release assembly 70 mounted on the underside of arm assembly 28. When the latch release assembly 70 is in latched condition as shown in solid outline in FIG. 2 the end limits of possible stroking movement of the arm assembly 28 relative to the main support structure 22 is controlled by means included in the slide assembly 60. This latched condition is the condition used during stroking of the mandrel assembly 34 in its vertical orientation. In the unlatched condition, which will be described later, the free end 29 of the arm assembly 28 is able to be raised still farther above the machine and this condition is provided so that the mandrel assembly 34 will be able to be moved to clear the bore being honed. In this raised position the main support structure 22 including the arm assembly 28 and the mandrel assembly 34 can be moved horizontally along rail means at the rear of the machine as will be described to positions for honing in other vertically oriented cylinder bores. Also, in the raised position, the mandrel assembly 34 is clear of the workpiece and, if desired, can be installed on or detached from the bayonet coupling means 32.

Referring again to FIGS. 2 and 9, the limits of stroking movement of the arm assembly 28 is determined prior to a honing operation by setting adjustable top and bottom stop members 72 and 74, respectively, which are included as parts of the slide assembly 60. The stops 72 and 74 are selectively locked in position on rod member 76 which rod member 76 slides through a bracket assembly 78. The stops 72 and 74 are locked in position on the rod 76 by respective pivotal locking levers 80 and 82. The upper limit of each honing stroke is reached when the arm assembly 28 is moved upwardly to a position where the stop 72 contacts one side of bracket end member 84 of the bracket assembly 78. This prevents further upward pivotal movement of the arm assembly 28 and the mandrel assembly 34 attached thereto. Similarly, the lower limit of the stroking motion is reached when the arm assembly 28 is pivoted downwardly to a position where the stop 74 contacts the opposite side of the same end member 84.

The end member 84 also carries a spring biased pin 86 which is biased by spring 88 which engages a collar 89 on the pin 86. During stroking the pin 86 is withdrawn from a slot or bore 90 in the rod 76 to enable relative movement between the bracket assembly 78 and the rod 76. The pin 86 is pivotally connected to a cam lever 92 at pivot point 93 which when turned to the position shown in FIG. 9 retracts the pin 86 from the slot 90 and enables the rod 76 to move relative to the bracket assembly 78 as aforesaid for stroking. When the pin 86 is allowed to enter the slot 90 by operation of the cam lever 92 the rod 76 is locked in fixed position relative to the bracket assembly 78 and no stroking can take place. However, in the locked position the positions of the stroke limit stops 72 and 74 can be set as desired and locked. The locked position is also used to maintain the support structure 22, and the arm assembly 28 in fixed angular position during horizontal honing as will be described.

Figure 8:
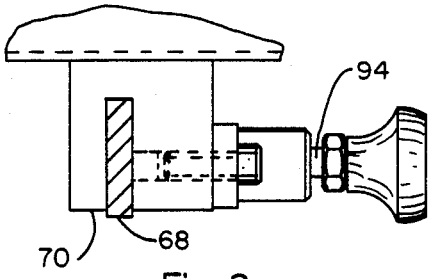
FIG. 8 is a fragmentary perspective view taken on line 8—8 of FIG. 4.

The latch release assembly 70 (FIG. 2) in its unlatched condition, as stated, also allows the arm assembly 28 to be elevated independent of the upper stroke limit stop 72. The "unlatching" of the latch release assembly 70 is accomplished by disengaging a locking pin 94 in the latch assembly 70 (FIG. 8), thereby releasing bracket arm 68 to which the upper end 66 of slide assembly rod 76 is attached. When unlatched the arm 68 is able to pivot about pivot point 95 relative to the latch assembly 70 (FIG. 2) so that the arm assembly 28 can be raised upwardly (phantom outline in FIG. 2) until the mandrel assembly 34 is clear of the bore in the workpiece. In this raised position the support structure 22 including the arm assembly 28 and the attached mandrel assembly 34 are able to be moved sideways along rail means to a position to hone in another cylinder bore. Also, in the unlatched raised condition of the latch assembly 70 the arm assembly 28 is able to be moved upwardly sufficiently so that the mandrel assembly 34 can be disengaged from the coupling means 32 for removal or replacement. The coupling means 32 is preferably a bayonet type coupling which makes it relatively easy to make the connection and disconnection of the mandrel assembly 34. After honing all of the vertical cylinder bores that need to be honed, but before moving the support structure 22 to its second or lowered orientation, it is necessary to operate other release means which will be described later and which are provided to maintain the support structure 22 in its upstanding position.

The main support structure 22 is slidably supported on horizontal rail 96 (FIG. 2) located adjacent to the upper edge of the rear housing wall 24 of the machine housing 26. The rail 96 is shown as a round tubular member, and the support structure is attached to a tubular member 98 which is slidably supported on the rail 96 by bearing members (not shown) which are positioned therebetween. The tubular member 98 has a downwardly extending leg portion 100 which is connected at its lower end to a cross member 102 to which are attached two spaced rollers 104 and 106 which engage opposite sides of a horizontal track 108. The track 108 extends along the lower edge of the rear housing wall 24. The main support structure 22 is pivotally connected to and supported by the leg portion 100 on shaft 110.

It is important to understand that the main support structure 22 is pivotal on the shaft 110 from the vertical position shown in FIGS. 1, 2, 3, 10 and 13 to the horizontal position as shown in FIGS. 10 and 13. It is also important that the main support structure 22 be accurately positioned in each of its operative positions and that it be latched in at least its vertical position so that it will not be able to move relative to the support shaft 110. Referring to FIG. 13, it can be seen that the leg 100 carries a threadedly adjustable stop member 112 which engages a stud 114 located on the support structure 22 to establish the vertical orientation of the structure 22. The tube 98 which is connected to the leg 100 carries another threadedly adjustable stop member 116 which is engaged by the same stud 114 to control the horizontal orientation of the structure 22. It can therefore be seen that the stops 112 and 116 determine how far the support structure 22 can be moved between its vertical and horizontal positions and both stops are adjustable to accurately determine the position of the support structure 22 in both locations thereof.

Figure 11:
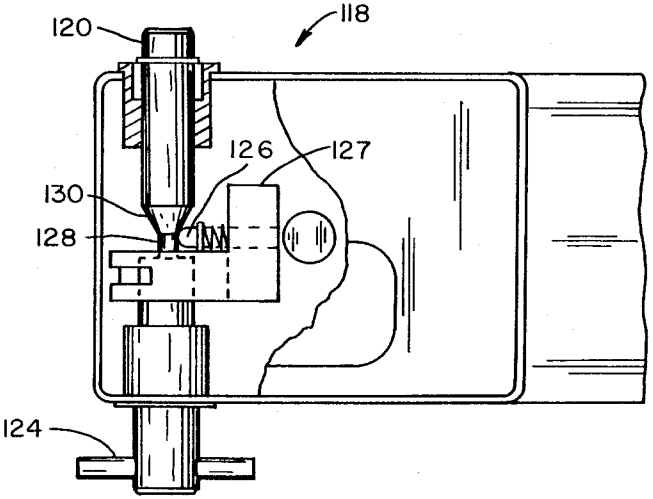
FIG. 11 is a fragmentary cross-sectional view taken on line 11—11 of FIG. 3 showing a wedge pin in position to maintain the main support structure in position for vertical honing.
Figure 12:
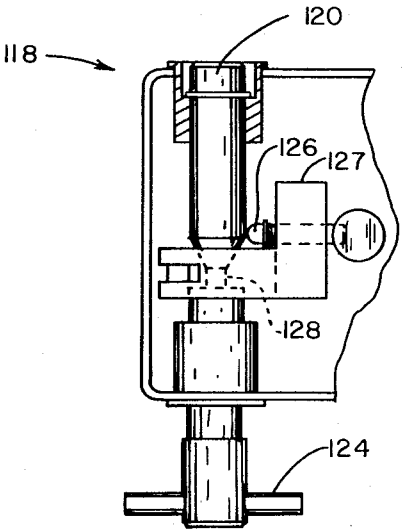
FIG. 12 is a cross-sectional view similar to FIG. 11 but showing the wedge pin in position to enable the main support structure to be moved to a position for honing in a horizontal orientation and to deactivate the arm assembly counterbalance means.

In the vertical orientation of the structure 22, the structure is latched against movement by latch means 118 shown in FIGS. 10, 11 and 12. In the latched condition the latch means 118 are as shown in FIGS. 2 and 11 wherein latch pin 120 extends forwardly from the support assembly 22 to a position extending under a rearwardly extending ledge 122 (FIG. 2) of the tubular member 98. The latched condition is accomplished with the assembly 22 upstanding by applying forward force to handle 124 which is connected to the latch pin 120. In the latched condition a spring biased pin 126 mounted in a bore through support member 127 is moved to the left as shown in FIG. 11 to a position engaging a smaller diameter portion 128 of the latch pin 120. By contrast in the unlatched condition shown in FIG. 12 the handle 124 is pulled rearwardly from the structure 22 and in so doing the latch pin 120 causes the spring biased pin 126 to be moved by conical pin surface 130 to a retracted position. In this position the latch pin 120 is clear of the ledge 122 so that the assembly 22 can be pivoted about the support shaft 110. The latch pin 120 is retained in the unlatched condition when the support structure 22 is in its overturned position (FIG. 10) by a keeper 131 that is pivotally connected to support member 127 at pivot point 132 and which operates under force of gravity to bear against the narrow diameter pin portion 128, and the abutting pin surface prevents unwanted forward motion of the latch pin 120.

Figure 3:
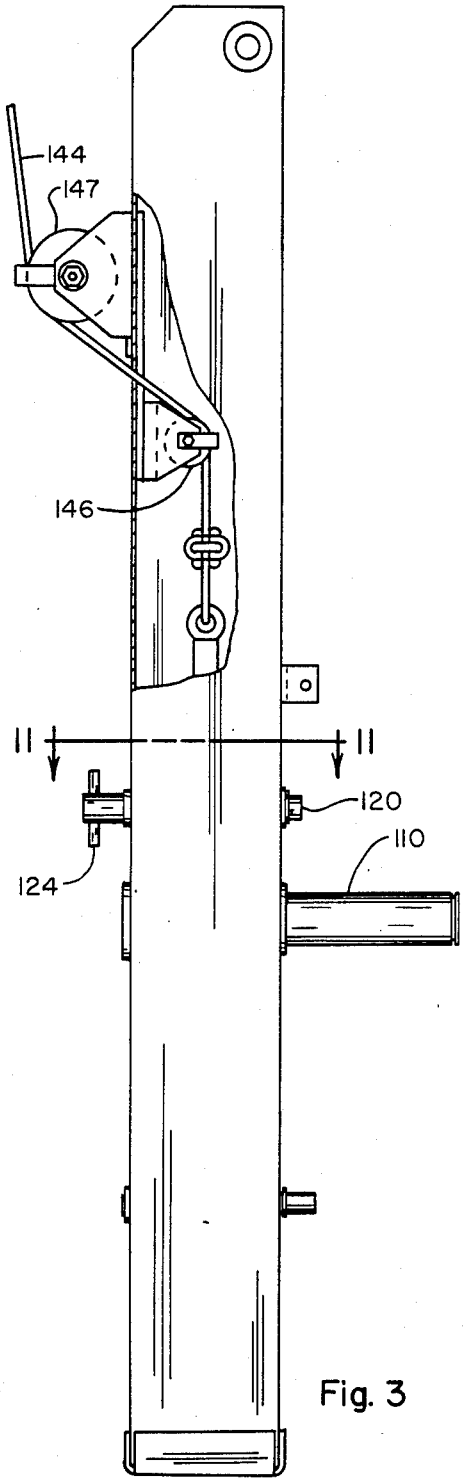
FIG. 3 is a side elevational view of the main support structure for the subject machine with a portion thereof cut away to disclose the counterbalancing mechanism for the arm assembly.

The spring biased pin 126 plays an important part in the process of changing from vertical to horizontal honing. Referring to FIGS. 2, 3 and 10 it can be seen that the arm assembly 28 is counterbalanced in its vertical position only by a counterbalance spring 133 located inside the support structure 22. The counterbalance spring 133 is positioned in a spring housing 134 and extends between a lower piston member 135 and an upper housing wall 136. The piston 135 is connected to one end of an elongated rod member 138 which extends upwardly through a hole in the wall 136. The rod 138 has an upper end portion 140 which has an eyelet member 142 attached thereto. The eyelet 142 is fixedly connected to a flexible cord 144 by suitable means as shown, and the cord 144 after extending around pulley wheels 146 and 147 has its opposite end connected to a rearwardly extending portion 148 (FIG. 2) of the arm assembly 28. The force of the spring 133 acting on the lever arm provided by the rearwardly extending portion 148 of the arm assembly 28 counterbalances the arm assembly 28 and makes it relatively easy for the operator to manually stroke the arm assembly 28 when honing in vertical bores.

Referring again to FIG. 10, it can be seen that the rod member 138 has a reduced diameter portion 150 that forms a notch into which the pin 126 moves when the latch pin 120 is moved to its retracted position as shown in FIG. 12. This prevents movement of the rod 138 and therefore neutralized the effect of the counterbalance spring 133 so that it has no counterbalance effect on the arm assembly 28 when the support structure 22 is moved from its vertical to its horizontal position.

Referring again to FIG. 2, the forward end portion 29 of the arm assembly 28 has a forwardly extending plate 152 with a plurality of arcuately spaced openings 154 therethrough. The plate 152 has a lever arm 156 pivotally mounted thereon at 158, and the arm 156 carries a knob 160 that includes a pin portion (not shown) that can be positioned extending into any desired one of the openings 154. The arm 156 carries clamping means 162 for clamping to a rod 164 in any desired extended position thereof. The free end of the rod 164 is attached at an intermediate location to a handle bar 166 which is gripped by the operator during the honing of vertical surfaces and is used to stroke the mandrel in the workpiece surface.

The front face of the arm assembly 28 (FIG. 7) has an on-off control knob 168 which is pulled to a forward position to apply hydraulic pressure to rotate the coupling 32 and the honing assembly 34 attached thereto. The front face also has an electric switch 170 mounted thereon to control the energizing of pump means (not shown) which provide the flow of honing fluid needed to operate to the machine. The electrical leads extend through conduit 171 shown in FIG. 6.

Of special significance to the present construction are the means which enable the main support structure 22 to be moved from its upstanding position to its horizontal position for honing horizontally-oriented cylindrical surfaces such as to hone relatively long bore surfaces and surfaces such as the spaced cylindrical surfaces which form the main bearing surfaces of an engine block. When the handle 124 is pulled out to release the support structure 22 for angular movement and to lock the counterbalance spring 133, the structure 22 can be overturned with safety to its horizontal position as shown in FIG. 10.

When the support structure 22 is in its horizontal position the stud 114 engages the threaded member 116 (FIG. 13) as aforesaid and the weight of the structure 22 with the attached arm 28 maintains this position. In the horizontal position and with the mandrel positioned extending through the surfaces to be honed, the mandrel can be attached to the coupling means 32. Thereafter when the mandrel, which may be of several different embodiments, including the mandrels identified in Sunnen U.S. Pat. Nos. 3,216,155; 3,378,962 and 3,800,482, is rotated by the hydraulic motor 48, the support structure 22, the arm assembly 28 (which is no longer counterbalanced) and the mandrel can be stroked. These structures are easily moved or stroked linearly being guided in such movement by the rail 96 and the bearing members which support the tubular member 98 thereon. Movement of these structures is also controlled by engagement of the rollers 104 and 106 on opposite sides of the track member 108.

It is important to recognize that the same mandrel used to hone the vertically oriented cylinder bore may be used to hone long continuous workpiece bores such as hydraulic cylinders with the support structure oriented horizontally and a linear stroking motion guided by the rail 96.

Figure 14:
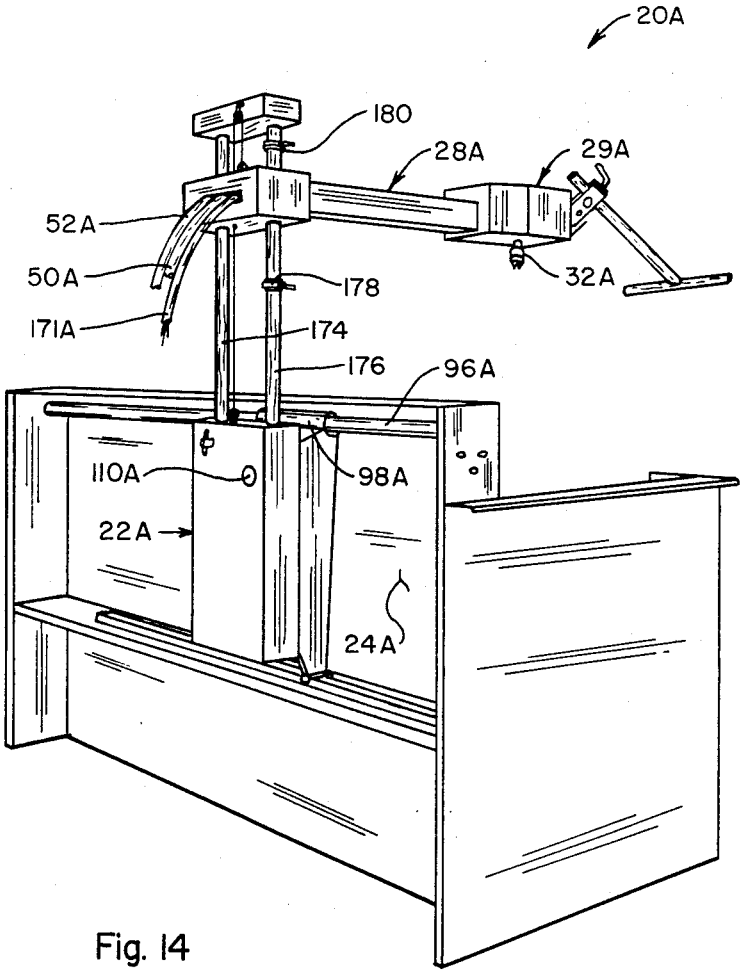
FIG. 14 is a perspective view similar to FIG. 1 but showing the machine designed for linear stroking in two different orientations.

FIG. 14 shows an alternate embodiment 20A wherein arm assembly 28A is counterbalanced in substantially the same way as described above but is mounted to move linearly in the vertical orientation being guided during such movements by spaced parallel rails 174 and 176. The rail 176 is shown having adjustable spaced stop rings 178 and 180 mounted thereon to control the lower and upper limits of the vertical stroking motion. The support structure 22A is pivotal about a pivot shaft 110A between a vertical and a horizontal position as in the embodiment shown in FIG. 1. The main difference between the structures is that embodiment 20 uses a pivotal arm movement to produce the vertical stroking while the embodiment 20A uses a linear arm movement to produce the vertical stroking.

Thus there has been shown and described a novel honing machine construction which fulfills all of the objects and advantages sought therefor. It will be apparent to those skilled in the art, however, that many changes, variations, modifications and other uses and applications for the subject device are possible. All such changes, variations, modifications and other uses and applications which do not depart from the spirit and purpose of the invention are deemed to be covered by the invention which is limited only by the claims which follow.

What is claimed is:

1. A honing machine comprising a housing having spaced opposed front and rear walls and spaced side walls connected therebetween, a horizontally extending rail positioned adjacent to the rear wall, an elongated support structure and means for mounting the support structure for horizontal movement on the rails, said support structure including pivot support means to enable the support structure to be moved between a first operative position extending in substantially a vertical orientation to a free upper end thereof and a second operative position extending substantially horizontally relative to the rear wall, an elongated arm assembly having a first end connected to the support structure adjacent to the free end thereof and a second end positioned extending forwardly therefrom so that the arm assembly extends above the space defined by and between the front, rear, and side walls of the housing in the vertical position of the support structure, the second end of the arm assembly being movable substantially vertically relative to the support structure in the vertical position, said arm assembly extending forwardly parallel to the side walls in the horizontal position of the support structure, means adjacent to the second end of the arm assembly for coupling the arm assembly to a honing mandrel assembly, and means to enable the support structure, the arm assembly and a honing mandrel assembly operatively connected thereto to move linearly in concert in a horizontal direction being guided in said movement by the rail when the support structure is in its second operative position.

2. The honing machine of claim 1 including means to counterbalance the arm assembly on the support structure in the vertical position of said support structure to facilitate relative movement therebetween.

3. The honing machine of claim 2 including means to disable the counterbalance means for the arm assembly prior to moving the support structure from its vertical to its horizontal position.

4. The honing machine of claim 1 including means to enable the arm assembly to move pivotally relative to the support structure in the vertical position of the support structure.

5. The honing machine of claim 4 including means to limit relative pivotal movement between the elongated arm assembly and the support structure in the first operative position of the support structure.

6. The honing machine of claim 1 including latch type release means operable in the latched condition thereof to maintain the support structure in its vertical position, said latch release means being releasable to enable the support structure to be moved to its horizontal position.

7. The honing machine of claim 4 including means to lock the arm assembly in fixed angular orientation relative to the support structure.

8. The honing machine of claim 1 including motor drive means located on the arm assembly operatively connected to the means for coupling the arm assembly to the mandrel assembly, and means to energize the motor drive means to rotate the mandrel assembly.

9. The honing machine of claim 8 wherein the motor drive means is an hydraulic motor.

10. The honing machine of claim 1 wherein the means on the arm assembly for coupling to the honing mandrel assembly includes a bayonet coupling means.

11. In a honing machine capable of alternatively honing workpiece surfaces oriented vertically and horizontally comprising a machine housing having an enclosed side wall and means positioned in the space defined thereby to support a workpiece having workpiece surfaces to be honed, rail means positioned extending along a portion of the enclosed side wall, an elongated support structure and means mounting said support structure for linear movement along the rail means, said means mounting the support structure including means enabling the elongated support structure to be moved between a first operative position extending substantially vertically adjacent to the machine side wall to a second operative position extending substantially parallel to the rail means, arm means attached adjacent to one end of the support structure in position to extend therefrom over the space defined by the enclosed wall in the first operative position of the support structure, said arm means extending forwardly from the support structure to a position adjacent to one side of the enclosed side wall in the second operative position of the support structure, means to enable limited vertical movement of at least a portion of the arm means in said first operative position, means to prevent relative angular movement between the arm means and the support structure in the second operative position thereof whereby the support structure and the arm means can move linearly in concert in the second operative position, and means on the arm means for coupling to a honing mandrel assembly.

12. In the honing machine of claim 11, means to counterbalance the arm means on the support structure in the first operative position of the support structure.

13. In the honing machine of claim 12, means to disable the counterbalance means when moving the support structure to the second operative position thereof.

14. In the honing machine of claim 11, means to establish the position of the support structure in the first and second operative positions thereof.

15. In the honing machine of claim 11, means adjustable to establish upper and lower limits of stroke length for the arm means when the support structure is in its first operative position.

16. In a honing machine capable of alternatively honing workpiece surfaces oriented vertically and horizontally the improvement comprising an elongated support structure capable of being in a substantially vertical orientation for honing vertically oriented surfaces and movable to a substantially horizontal position for honing horizontally oriented surfaces, an arm assembly attached to a free end of the support structure and extendible therefrom in a forward direction, means to enable pivotal movement of the arm assembly on the support structure when the support structure is in its substantially vertical position, means on the arm assembly for coupling to a honing mandrel assembly for movement thereof in a substantially vertical direction when the arm assembly is pivoted on the support structure, a connection rod assembly having a first end connected to the support structure at a location spaced from the arm assembly and an opposite end connected to the arm assembly at a location spaced from the support structure, said rod assembly including a slide portion including means for changing the effective length of the connection rod assembly, said slide assembly having a first member adjustable thereon to determine the upper limit of movement of the arm assembly during stroking and a second member adjustable thereon to determine the downward limit of stroking movement of the arm assembly relative to the support structure, means to slidably support the support structure including the arm assembly attached thereto for linear movement thereof in the vertical and in the horizontal positions of the support structure, and means to establish a fixed orientation between the support structure and the arm assembly in the horizontal position thereof.

17. In the honing machine of claim 16, a handle bar assembly connected to the arm assembly to enable the operator to manually control the stroking thereof and of the honing mandrel assembly coupled thereto.

18. In the honing machine of claim 16, means to adjust the angular orientation of the handle bar assembly relative to the arm assembly.

19. In the honing machine of claim 16, a counterbalance spring located in the support structure, and means operatively connecting said counterbalance spring to the arm assembly to counterbalance the arm assembly to facilitate the ease of movement thereof during stroking of the mandrel assembly coupled thereto, means to latch the support structure in the vertical position thereof, and means to release the latch means to enable the support structure and the arm assembly attached thereto to be moved to the horizontal position, said latch release means including means to disable the counterbalance spring.

20. In the honing machine defined in claim 16 including means pivotally mounting the support structure for movement between its vertical and its horizontal positions, means engageable with the support structure in the vertical position thereof to establish the vertical position thereof, and other means engageable with the support structure in the horizontal position thereof to establish the horizontal position therefor.

21. In the honing machine defined in claim 16, means to support the support structure for linear movement on the honing machine including a horizontal rail member for supporting the support structure and a track member spaced from the aforesaid rail member.

22. A honing machine comprising a base structure for supporting a workpiece having at least one cylindrical surface to be honed thereon, a horizontal rail member extending adjacent to the base structure, an elongated support structure including means mounting the support structure for horizontal movement on the rail member, said support structure including pivotal support means to enable the support structure to be moved between a first operative position extending in substantially vertical orientation on the rail member to a free upper end thereof and a second operative position extending substantially parallel to the rail member, an elongated arm assembly attached to the support structure adjacent to the free upper end thereof and extending outwardly therefrom above the base structure and a workpiece positioned thereon, means on the arm assembly spaced from the support structure for coupling to a honing mandrel assembly, means to vertically move the arm assembly and the honing mandrel assembly attached thereto when the support structure is in the first operative position, means to establish a fixed angular orientation between the support structure and the arm assembly in the horizontal position of the support structure, and means to move the support structure including the arm assembly and the honing mandrel assembly as a unit along the rail member when the support structure is in the second operative position thereof.

23. The honing machine of claim 22 wherein the support structure and the arm assembly attached thereto are movable along the rail member in the first operative position of the support structure.

24. The honing machine of claim 22 wherein the support structure includes rail means mounted thereon, said arm assembly being mounted for movement along said rail means in the first operative position of the support structure.

25. The honing machine of claim 24 including means to counterbalance the arm assembly on the support structure in the first operative position thereof.

26. The honing machine of claim 25 including means to disable the arm assembly counterbalance means in the second operative position of the support structure.

27. The honing machine of claim 24 including means on the rail means adjustable to limit the range of movement of the arm assembly therealong.

28. A honing machine comprising a housing having spaced opposed front and rear walls and spaced side walls connected therebetween, a horizontally extending rail positioned adjacent to the rear wall, an elongated support structure and means for mounting the support structure for horizontal movement on the rail, said support structure including pivot support means to enable the support structure to be moved between a first operative position extending in substantially a vertical orientation to a free upper end thereof and a second operative position extending substantially horizontally relative to the rear wall, an elongated arm assembly having a first end connected to the support structure adjacent to the free end thereof and a second end positioned extending forwardly therefrom so that the arm assembly extends above the space defined by and between the front, rear, and side walls of the housing in the vertical position of the support structure and extends forwardly parallel to one of the side walls in the horizontal position of the support structure, means adjacent to the second end of the arm assembly for coupling the arm assembly to a honing mandrel assembly, means to enable the support structure, the arm assembly and a honing mandrel assembly operatively connected thereto to move together in a horizontal direction being guided in said movement by the rail when the support structure is in its second operative position, means to enable the arm assembly to move pivotally relative to the support structure in the vertical position of the support structure, means to limit relative pivotal movement between the elongated arm assembly and the support structure in the first operative position of the support structure, and latch means operatively connected to the means to limit relative pivotal movement of the arm assembly, said latch means having a latched condition wherein the pivotal movement of the arm assembly relative to the support is controlled by the means which limit the pivotal movement thereof and an unlatched condition whereby the arm assembly can pivot relative to the support structure beyond said range of limited relative movement therebetween.

29. In a honing machine capable of alternatively honing workpiece surfaces oriented vertically and horizontally comprising a machine housing having an enclosed side wall and means positioned in the space defined thereby to support a workpiece having workpiece surfaces to be honed, rail means positioned extending along a portion of the enclosed side wall, an elongated support structure and means mounting said support structure for linear movement along the rail means, said means mounting the support structure including means enabling the elongated support structure to be moved between a first operative position extending substantially vertically adjacent to the machine side wall to a second operative position extending substantially parallel to the rail means, arm means attached adjacent to one end of the support structure in position to extend therefrom over the space defined by the enclosed wall in the first operative position of the support structure, said arm means extending from the support structure to a position adjacent to one side of the enclosed side wall in the second operative position of the support structure, means to enable limited vertical movement of at least a portion of the arm means in said first operative position, means to prevent relative angular movement between the arm means and the support structure in the second operative position thereof whereby the support structure and the arm means can move in concert in the second operative position, means on the arm means for coupling to a honing mandrel assembly, means adjustable to establish upper and lower limits of stroke length for the arm means when the support structure is in its first operative position, and latch means operatively connected between the means adjustable to establish the upper and lower limits of stroke length and the arm means, said latch means having a latched inoperative condition and an unlatched condition, the unlatched condition enabling the arm means to be pivoted upwardly on the support structure beyond the established upper stroke limit.

30. In a honing machine capable of alternatively honing workpiece surfaces oriented vertically and horizontally the improvement comprising an elongated support structure capable of being in a substantially vertical orientation for honing vertically oriented surfaces and movable to a substantially horizontal position for honing horizontally oriented surfaces, an arm assembly attached to a free end of the support structure and extendible therefrom in a forward direction, means to enable pivotal movement of the arm assembly on the support structure when the support structure is in its substantially vertical position, means on the arm assembly for coupling to a honing mandrel assembly for movement thereof in a substantially vertical direction when the arm assembly is pivoted on the support structure, a connection rod assembly having a first end connected to the support structure at a location spaced from the arm assembly and an opposite end connected to the arm assembly at a location spaced from the support structure, said rod assembly including a slide portion including means for changing the effective length of the connection rod assembly, said slide assembly having a first member adjustable thereon to determine the upper limit of movement of the arm assembly during stroking and a second member adjustable thereon to determine the downward limit of stroking movement of the arm assembly relative to the support structure, means to slidably support the support structure including the arm assembly attached thereto for linear movement thereof in the vertical and in the horizontal positions of the support structure, means to establish a fixed orientation between the support structure and the arm assembly in the horizontal position thereof, means pivotally mounting the support structure for movement between its vertical and its horizontal positions, means engageable with the support structure in the vertical position thereof to establish the vertical position thereof, and other means engageable with the support structure in the horizontal position thereof to establish the horizontal position therefor, the means to establish the vertical and horizontal positions of the support structure include a fixed stop member located on the support structure and adjustable means on the honing machine engageable by the fixed stop member.

* * * * *